US011898813B2

(12) United States Patent
Gibbens et al.

(10) Patent No.: US 11,898,813 B2
(45) **Date of Patent: *Feb. 13, 2024**

(54) CARBINE ASSEMBLY

(71) Applicant: Gibbens Engineering Group, LLC, Mesa, AZ (US)

(72) Inventors: Kevin W. Gibbens, Mesa, AZ (US); David W. Gibbens, Mesa, AZ (US)

(73) Assignee: Gibbens Engineering Group, LLC, Mesa, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/882,863

(22) Filed: Aug. 8, 2022

(65) Prior Publication Data

US 2023/0152051 A1 May 18, 2023

Related U.S. Application Data

(63) Continuation of application No. 17/154,930, filed on Jan. 21, 2021, now Pat. No. 11,408,701.

(60) Provisional application No. 62/963,952, filed on Jan. 21, 2020.

(51) Int. Cl.

| | |
|---|---|
| ***F41A 17/36*** | (2006.01) |
| ***F41C 7/00*** | (2006.01) |
| ***F41A 3/74*** | (2006.01) |
| ***F41A 3/68*** | (2006.01) |
| ***F41A 3/66*** | (2006.01) |

(52) U.S. Cl.

CPC ..... *F41A 17/36* (2013.01); *F41A 3/66* (2013.01); *F41A 3/68* (2013.01); *F41A 3/74* (2013.01); *F41C 7/00* (2013.01)

(58) Field of Classification Search

CPC ..... F41A 33/66; F41A 33/68; F41A 17/36; F41C 7/00

USPC ..... 89/33.01, 33.04

See application file for complete search history.

(56) References Cited

U.S. PATENT DOCUMENTS

| | | | | |
|---|---|---|---|---|
| 3,421,408 | A | 1/1969 | Badali et al. | |
| 4,617,749 | A | 10/1986 | Jurek | |
| 4,664,015 | A | 5/1987 | Kennedy | |
| 6,510,778 | B1 | 1/2003 | Irwin | |
| 7,219,462 | B2 | 5/2007 | Finn | |
| 9,448,020 | B1 | 9/2016 | Olson | |
| 10,215,519 | B2 * | 2/2019 | Drake | F41A 35/06 |
| 11,408,701 | B2 * | 8/2022 | Gibbens | F41A 17/36 |
| 2017/0234638 | A1 | 8/2017 | Noonan | |
| 2018/0080730 | A1 | 3/2018 | Cook et al. | |
| 2018/0347924 | A1 | 12/2018 | Satern | |
| 2021/0018284 | A1 | 1/2021 | Stroda | |

* cited by examiner

*Primary Examiner* — Bret Hayes

(74) *Attorney, Agent, or Firm* — Schmeiser, Olsen & Watts LLP; Sean K. Enos

(57) ABSTRACT

Provided is a fast cycling/low recoil pistol caliber carbine assembly. The carbine assembly may include an upper receiver, a lower receiver, a feed ramp, a bolt stop, a magazine, a control mechanism comprising a control lever, a control base, a control pivot pin, and a control spring, an ejector, a gap filler member. The assembly provides last round bolt hold open, trigger finger actuated bolt release, short stroke cycle, barrel ramp, ambidextrous magazine release, and uses Glock magazines.

8 Claims, 16 Drawing Sheets

CARBINE ASSEMBLY

CROSS REFERENCE TO RELATED APPLICATION

This application is a continuation of the earlier U.S. Utility patent application Ser. No. 17/154,930, filed Jan. 21, 2021, which claims priority to U.S. Provisional Patent Application Ser. No. 62/963,952, filed Jan. 21, 2020, the disclosures of which are hereby incorporated entirely herein by reference.

BACKGROUND OF THE INVENTION

Technical Field

This invention relates generally to a carbine assembly for an AR type rifle and more particularly to a fast cycling/low recoil pistol caliber carbine assembly.

State of the Art

Carbine assemblies for AR15 style rifles are available for use of pistol caliber ammunition. However, these existing carbine assemblies are lacking their functionality, namely they are not fast cycling/low recoil pistol caliber carbine assemblies. Accordingly, there is a need for fast cycling/low recoil pistol caliber carbine assemblies.

DISCLOSURE OF THE INVENTION

The present invention relates to a carbine assembly for an AR15 style rifle that is a fast cycling/low recoil pistol caliber carbine assembly. The assembly provides last round bolt hold open, trigger finger actuated bolt release, short stroke cycle, barrel ramp, ambidextrous magazine release, uses Glock magazines and the like.

An embodiment includes a carbine assembly comprising: an upper receiver; a lower receiver with a magazine fillable with ammunition removably coupled to the lower receiver; a barrel; a bolt carrier; a buffer; and a bolt stop/feed assembly coupled within the upper receiver and the lower receiver, the bolt stop/feed assembly comprising: a control base; a control spring; a control lever; a bolt stop; and a feed ramp all configured to operate to feed ammunition into the barrel and stop the bolt carrier operation when a last round of ammunition is fired from the carbine assembly.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

Figure 1:
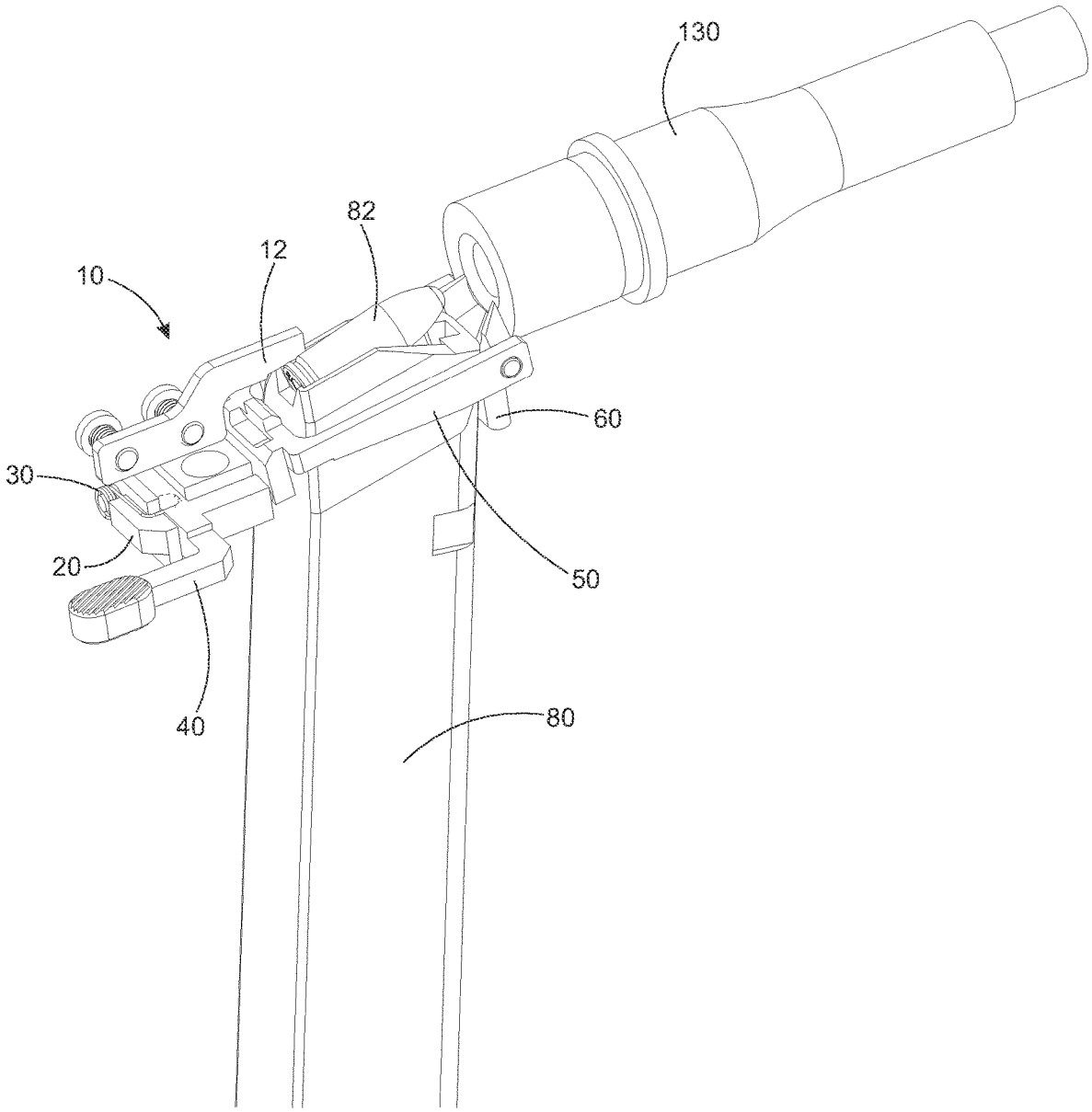
FIG. 1 is a perspective view of a portion of a carbine assembly in accordance with embodiments.

As discussed above, embodiments of the present invention relate a carbine assembly for an AR15 style rifle that is a fast cycling/low recoil pistol caliber carbine assembly. The assembly provides last round bolt hold open, trigger finger actuated bolt release, short stroke cycle, barrel ramp, ambidextrous magazine release, uses Glock magazines and the like.

Referring to the drawings, FIGS. 1-16 depict an embodiment of fast cycling/low recoil pistol caliber carbine assembly 100. Generally, the carbine assembly includes an upper receiver 110, a lower receiver 120, a bolt carrier 140, a buffer 150, a bolt stop/feed assembly 10, and an ejector 12. The bolt stop/feed assembly 10 comprises a control base 20, a control spring 30, a control lever 40, a bolt stop 50, a feed ramp 60 and a gap filling device 70. Other components discussed include a magazine 80. Other components that are internal to the carbine assembly 100, some shown without numbering and others not shown may include the following: a trigger, a hammer, firing pin, connectors for various components, screws for coupling elements together, a buffer and all buffer components internal to the buffer tube and so forth.

The buffer 150, in embodiments is a longer buffer than that for a .223 caliber ammunition buffer. This longer buffer 150 allows for a short stroke to fire pistol ammunition, such as 9 mm caliber ammunition. The bolt stop/feed assembly 10 operates to provide a bolt stop capability with the longer buffer that is currently not available in conventional carbine assemblies.

Figure 4A:
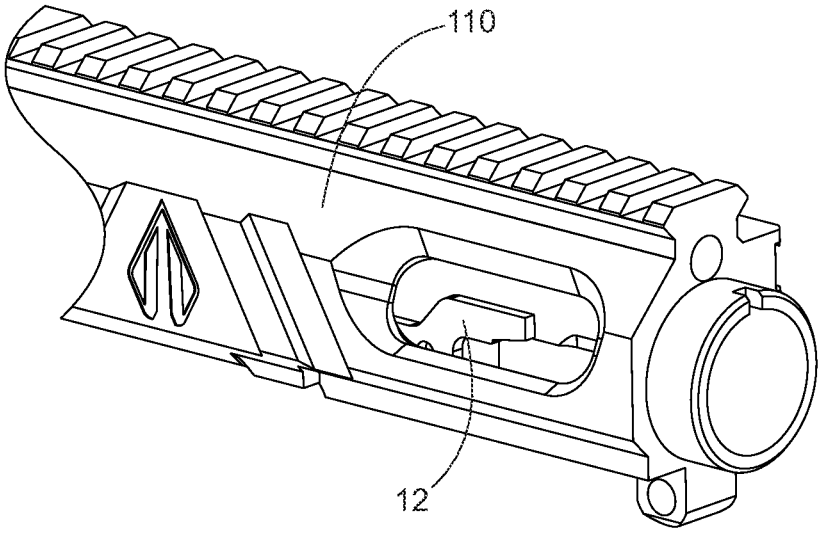
FIG. 4A is a perspective view of an upper receiver of a carbine assembly in accordance with embodiments.
Figure 4B:
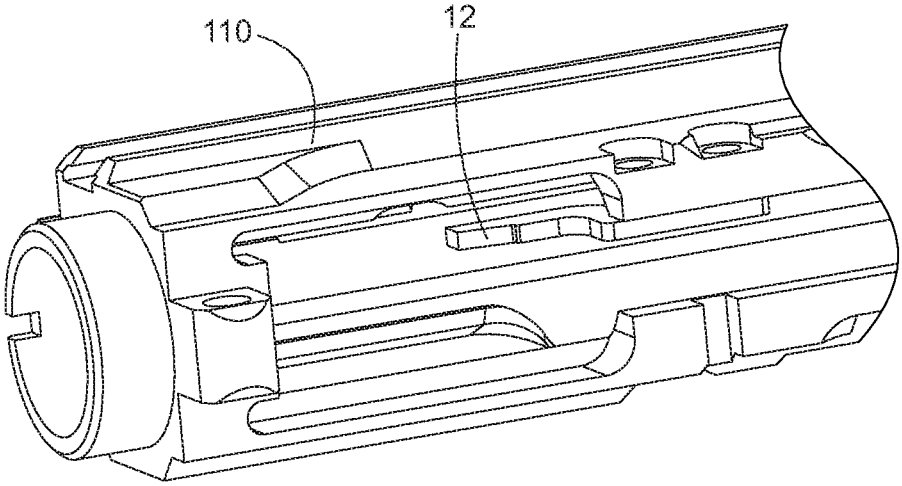
FIG. 4B is a perspective view of an upper receiver of a carbine assembly in accordance with embodiments.
Figure 5:
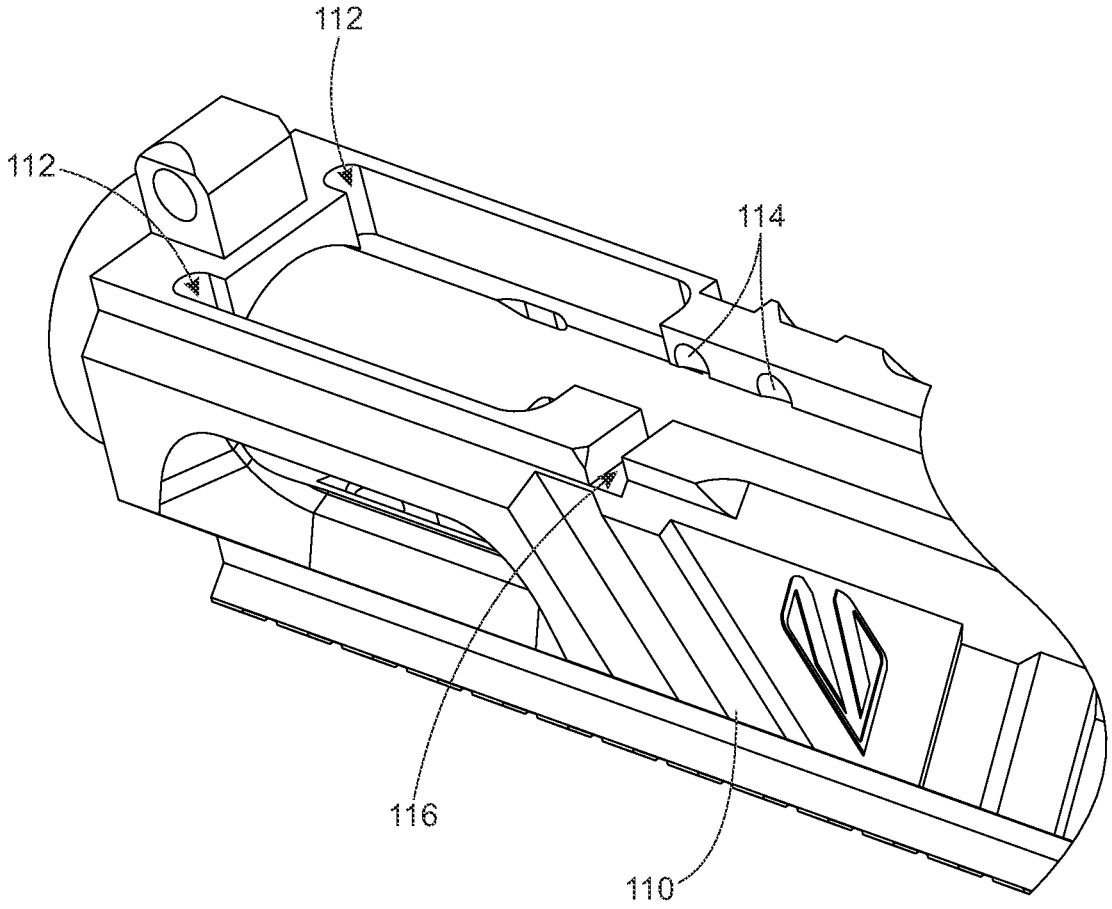
FIG. 5 is another perspective view of an upper receiver of a carbine assembly in accordance with embodiments.

An embodiment of the upper receiver 110 is depicted in FIGS. 4A-5. The upper receiver may include clearance cuts 12 for the bolt stop/feed assembly 10 to operate. These cuts for recesses in the upper receiver 110. The upper receiver 110 may further include screw holes 114 and surface for locating and securing the ejector 12 to the upper receiver 110. The upper receiver 110 may also include a gap 116 for the control lever 40 to extend through and operate as part of the bolt stop/feed assembly 10.

Figure 6:
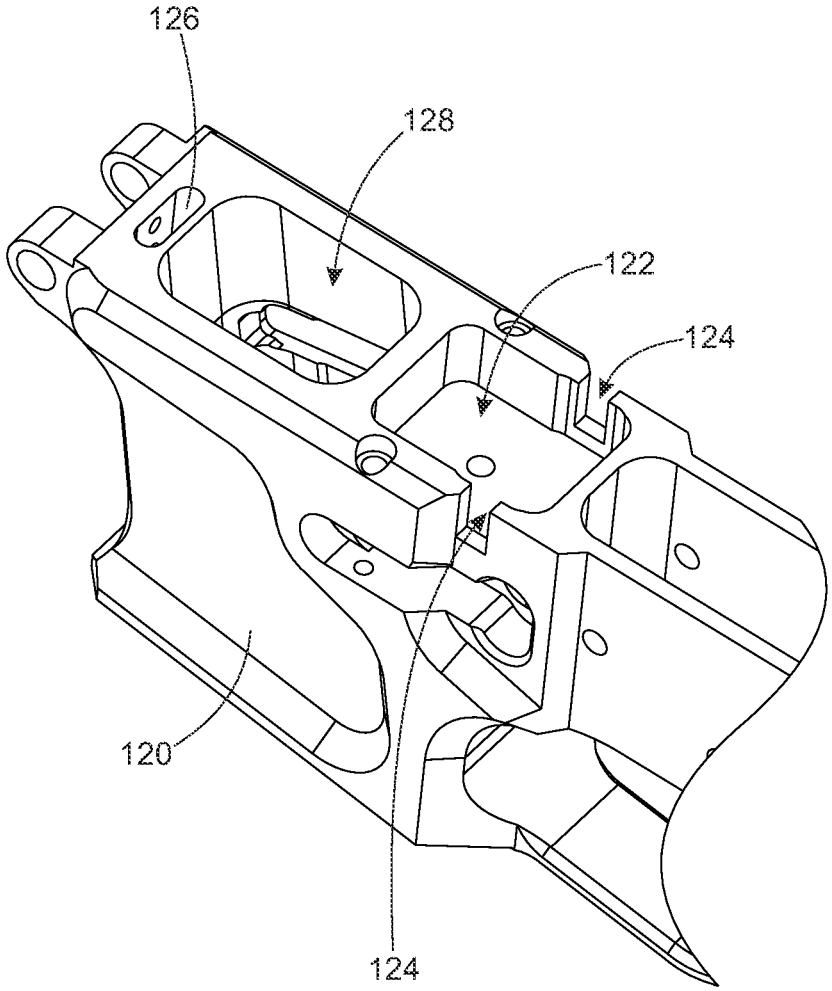
FIG. 6 is a perspective view of lower receiver of a carbine assembly in accordance with embodiments.

An embodiment of the lower receiver 120 is depicted in FIG. 6. The lower receiver 120 may include a pocket 126 and roll pin holes for locating and securing the feed ramp 60. There is also a mechanism pocket 122 to house the control base 20, control lever 40, control pin 35 and control spring 30. Additionally, the mechanism pocket 122 includes a threaded hole for securing the control base 20 within the pocket 122. The lower receiver 120 may also include a gap 124 on each side of the lower receiver for the control lever 40 to extend through and operate as part of the bolt stop/feed assembly 10. The lower receiver 120 may include aperture 128 for the magazine 80 to extend therethrough.

Figure 7:
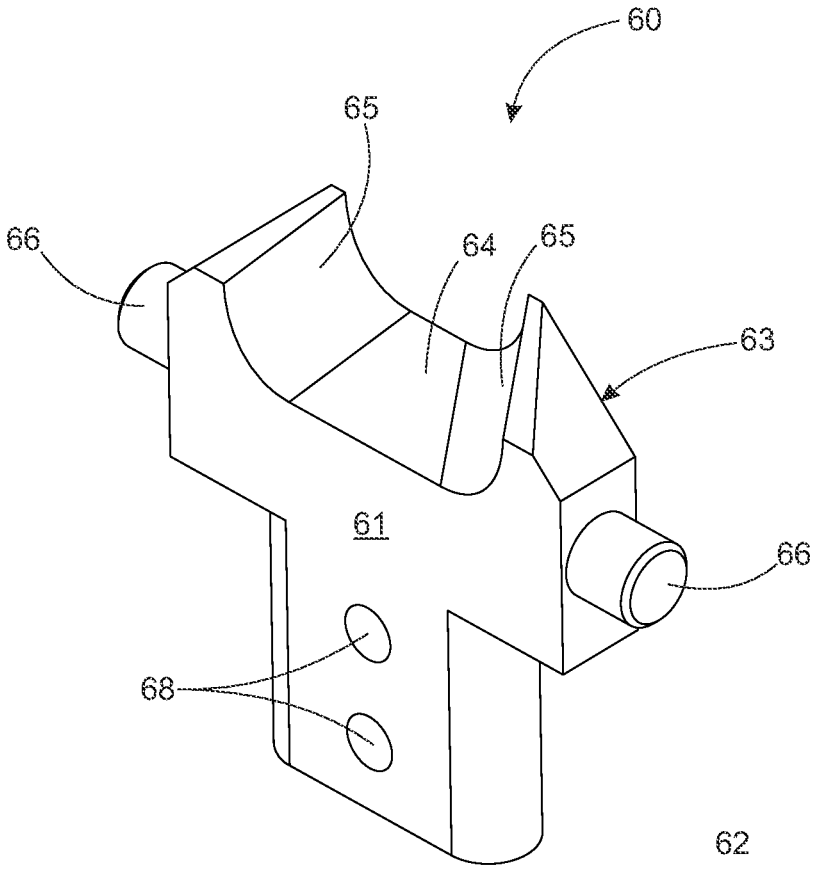
FIG. 7 is a perspective view of a feed ramp of a carbine assembly in accordance with embodiments.

An embodiment of the feed ramp 60 is depicted in FIG. 7. The feed ramp may include a cartridge feed ramp surface 64 that extends from a first surface 61 to a second surface 63, wherein the first surface faces the aperture 128 of the lower receiver 120 when the feed ramp 60 is coupled to the lower receiver 120. The feed ramp 60 may also include protrusion members 65 extending from each side of the feed ramp surface 64, each protrusion member 65 having a tapered surface, wherein the feed ramp surface 64 and protrusion members 65 with tapered surfaces operate to direct or otherwise funnel the cartridge 82 (ammunition 82) into the barrel 130 (See FIG. 1). The feed ramp 60 also includes bolt stop pivot bosses 66 that locates and provides a pivot point for the bolt stop 50. The feed ramp 60 also comprises a lower mount boss 62 that inserts into the pocket 126 of the lower receiver 120 to provide a foundation for the feed ramp 60, and the lower mount boss 62 includes roll pin holes 68, wherein roll pins extend through the roll pin holes 62 and corresponding holes in the lower receiver 120 to secure the feed ramp 60 in place. The feed ramp 60 is also an important feature because the bolt carrier 140 does not have a cup on the bottom in order to work with the feed ramp 60, by giving space to not contact the feed ramp 60. The lack of the cup on the bolt carrier 140 helps with the feeding of the ammunition as well. Further still, the ramp on bolt is removed or reduce in order to cock the hammer.

Figure 2:
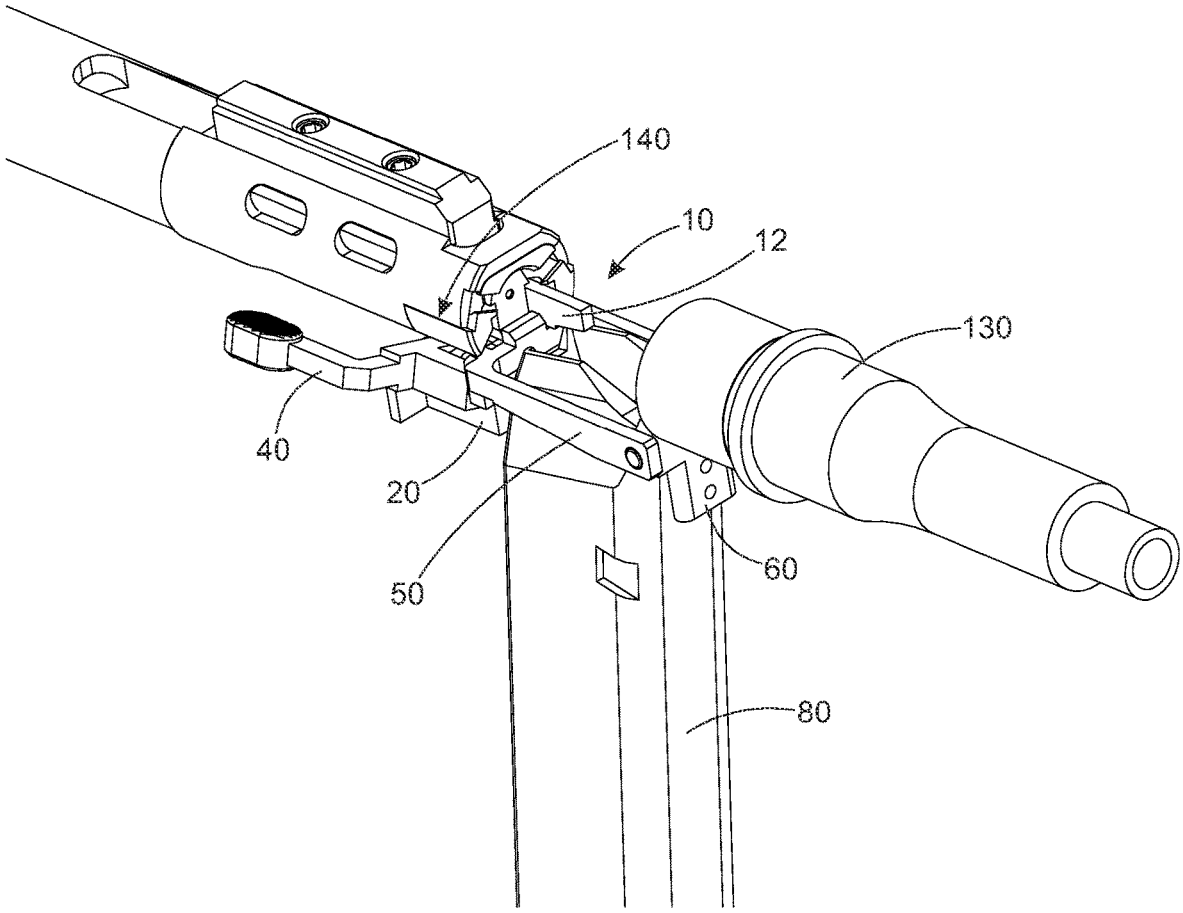
FIG. 2 is a perspective view of a portion of a carbine assembly in accordance with embodiments.
Figure 8:
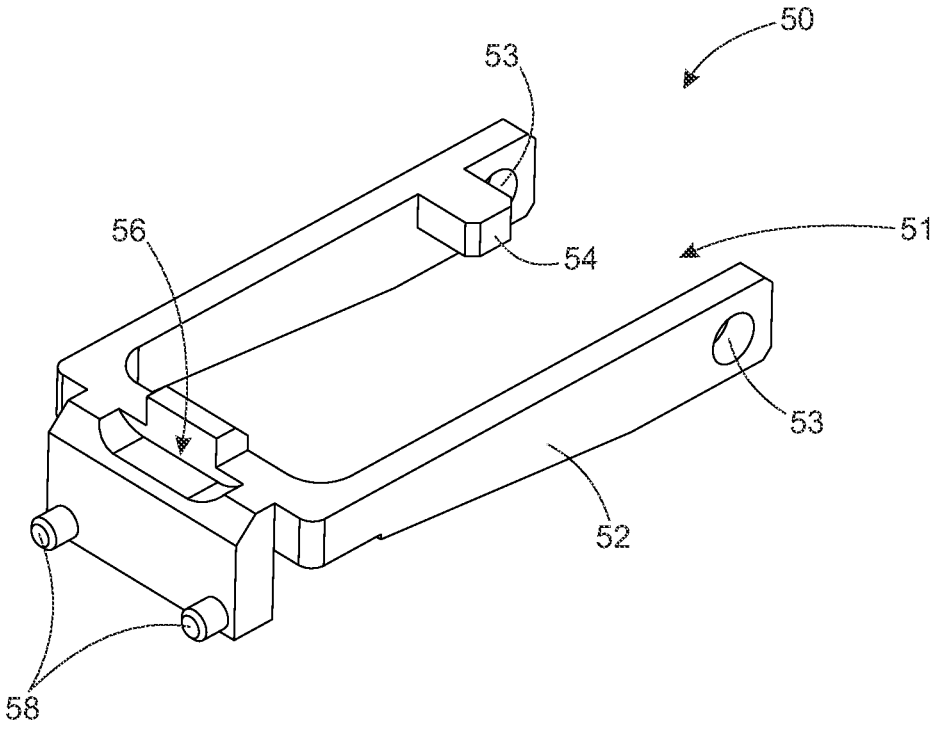
FIG. 8 is a perspective view of a bolt stop of a carbine assembly in accordance with embodiments.

An embodiment of the bolt stop 50 is depicted in FIG. 8. The bolt stop 50 may include a body 52 formed in a U-shape with a space 51 between two arms 55. The bolt stop 50 may include an activation tab 54 extending from one arm 55 that interfaces with the follower 84 in the magazine 80 (see FIG. 9) to push the bolt stop 50 into position to the stop the bolt carrier 140. While the activation tab 54 is shown located in a particular place on the arm 55, the activation tab may be located in various places depending on the magazine being used. Or some embodiments may include more than one activation tab 54 to account for various types of magazines without the need for a specific bolt stop 50. The bolt stop 50 includes bolt stop pivot holes 53 on the end of the arms 55 that mount to the bolt stop pivot bosses 63 of the feed ramp 60, wherein the bosses 63 extend into the bolt stop pivot holes 53. The bolt stop 50 may also include a bolt stop tab 56 that, when activated, prevents the forward motion of the bolt carrier 140, thereby locking it in a rearward position, as shown in FIG. 2. The bolt stop 50 also includes control bosses 58 that interfaces with the control lever 40 to activate or deactivate the bolt stop 50. One boss 58 is for a right-hand configuration and the other boss 58 is for a left-hand configuration.

Figure 9:
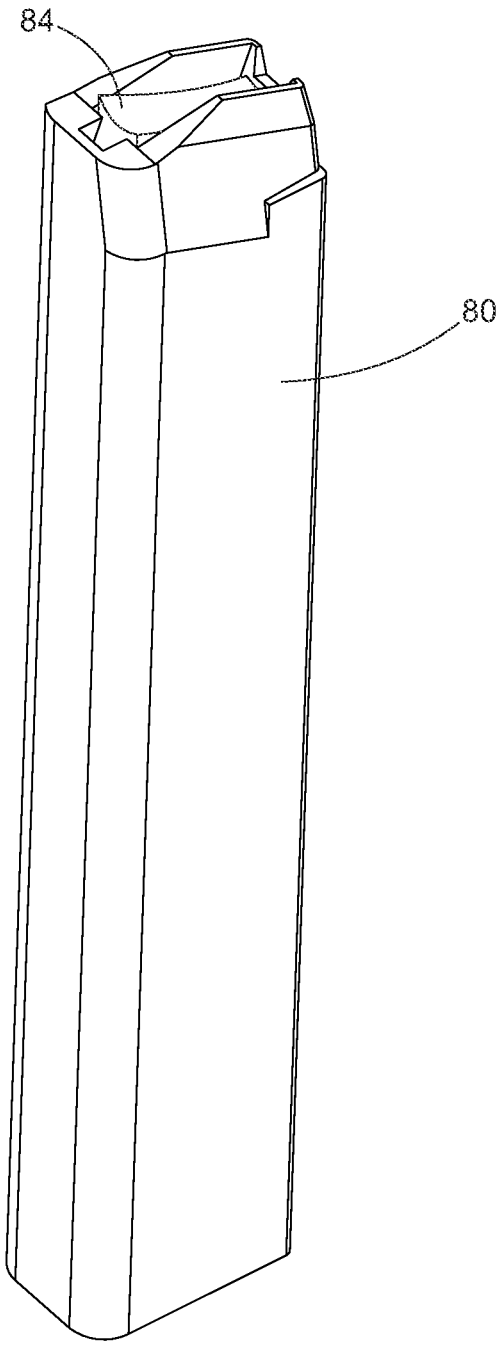
FIG. 9 is a perspective view of magazine of a carbine assembly in accordance with embodiments.

An embodiment of the magazine 80 depicted in FIG. 9 may include a magazine follower 84 that operates for a bolt stop activation feature.

Figure 10:
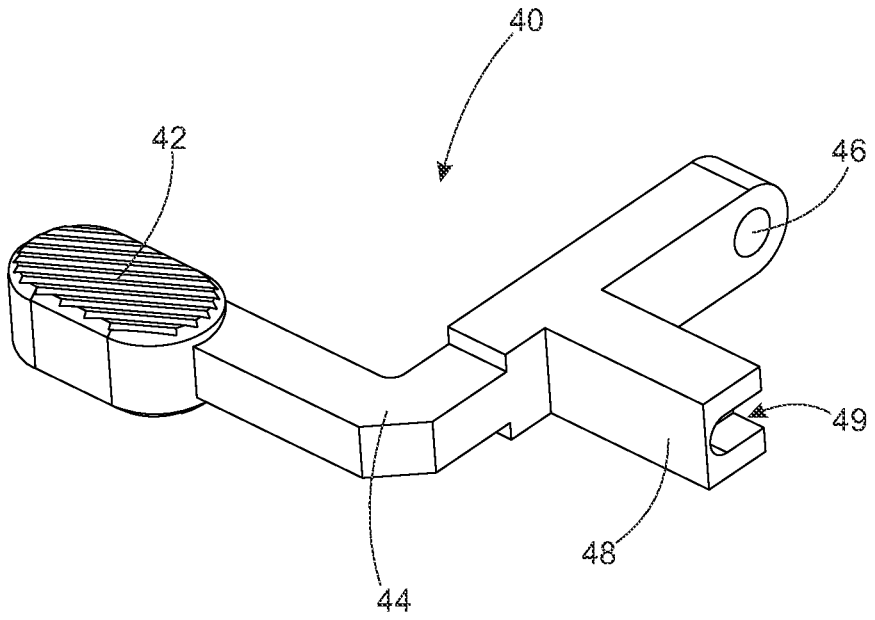
FIG. 10 is a perspective view of control lever of a carbine assembly in accordance with embodiments.

An embodiment of the control lever 40 depicted in FIG. 10. The control lever 40 may include a finger pad 42 located at the end of an arm 44 that extends out of the gaps 116 and 124 formed in the upper receiver 110 and the lower receiver 120 respectively to provide a control surface to activate or deactivate the bolt stop 50. The control lever 40 may further include a pivot hole 46 about which the control lever 40 pivots. Further, the control lever 40 may include a boss interface slot 49 that interfaces with the control bosses 58 on the bolt stop 50 to push the bolt stop 50 up or down.

Figure 11A:
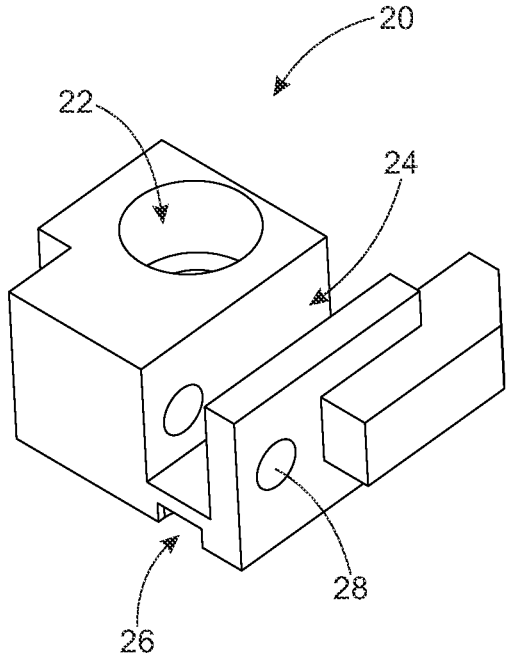
FIG. 11A is a perspective view of a control base of a carbine assembly in accordance with embodiments.
Figure 11B:
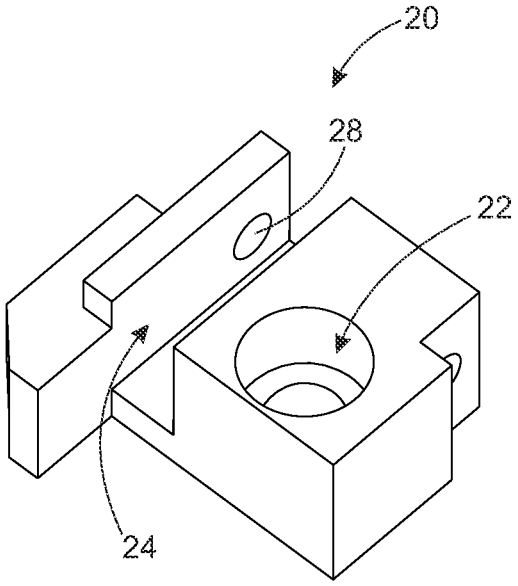
FIG. 11B is a perspective view of a control base of a carbine assembly in accordance with embodiments.

An embodiment of the control base 20 is depicted in FIGS. 11A-B. The control base 20 may include a mounting hole 22 for receiving a screw therethrough as a means to secure the control base 20 to the lower receiver 120, such as in the mechanism pocket 122. The control base 20 may include a notch 26 to locate and secure the gap filling device 70 wherein a protrusion 76 of the gap filling device 70 is engaged within the notch 26. The control base 20 may also include a control lever pivot hole 28 that provides a location for the control lever spring 30. The control base 20 may include a channel 24 for which the control lever 40 extends through the channel 24 and the pivot hole 46 aligns with the control lever pivot hole 28 of the control base 20 by use of the control pin 35. The control base 20 may also include a clearance notch to provide an area for travel of the unused control boss 58 on the bolt stop 50.

Figure 12:
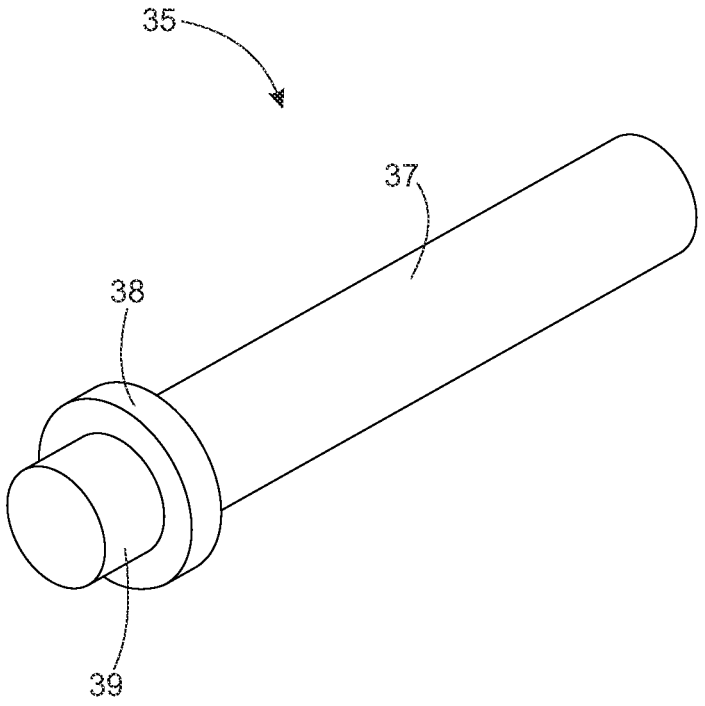
FIG. 12 is a perspective view of a control pivot pin of a carbine assembly in accordance with embodiments.

The control pivot pin 35 depicted in FIG. 12 is a control pivot pin 35 that includes a main locating shaft 37, a pin head 38 and a spring located boss 39. The main locating shaft 37 operates to locate position in the control base 20 and provides a shaft for the control lever 40 to pivot on. The pin head 39 is for locating and securing the pin 35 in its location.

Figure 13:
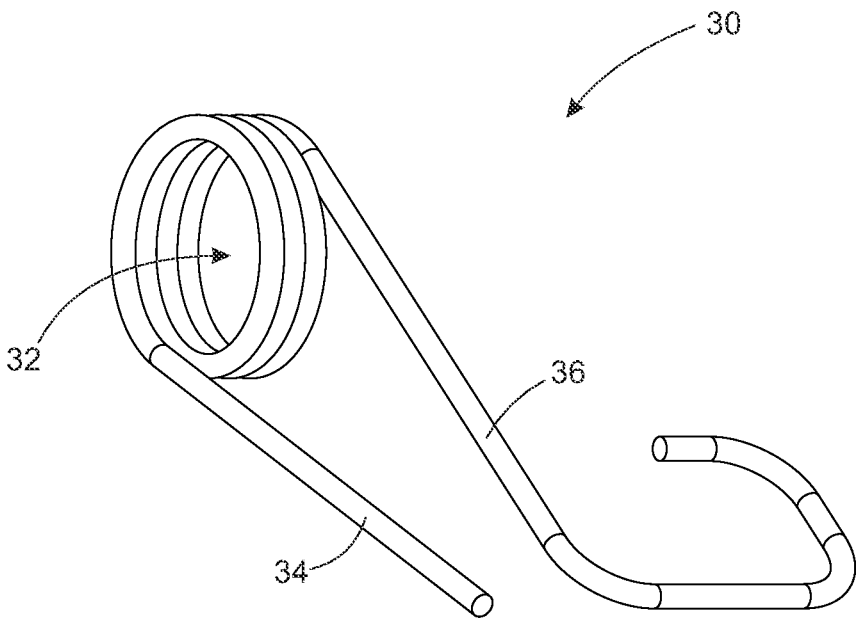
FIG. 13 is a perspective view of a control spring of a carbine assembly in accordance with embodiments.

An embodiment of the control spring 30 is depicted in FIG. 13. The control spring 30 may include a coil 32 that may be coupled around the pivot pin 35. The control spring 30 may also include a control lever engagement member 36 that engages the and pushes the control lever 40 down. The control spring 30 may include a control base engagement member 34 that engages and pushes against the control base.

Figure 14:
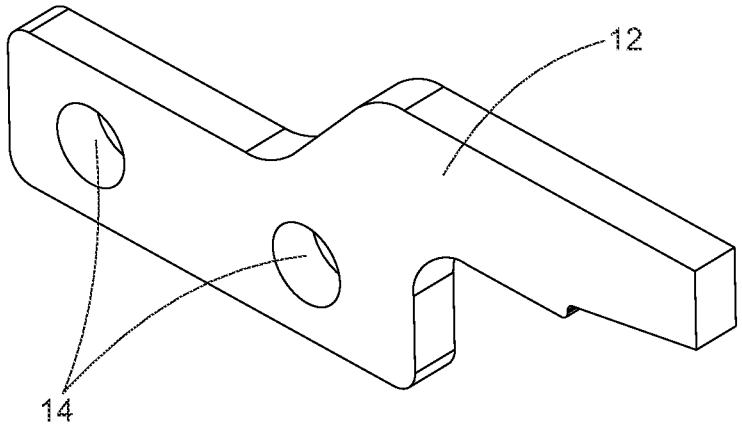
FIG. 14 is a perspective view of an ejector of a carbine assembly in accordance with embodiments.

An embodiment of the ejector 12 is depicted in FIG. 14. The ejector 12 may include a front surface 13 that impacts the back of the cartridge 82 of the ammunition and kicks it out the firearm. The ejector 12 may also include threaded holes 14 that operate to couple the ejector 12 to the upper receiver 110. The ejector 12 may also include an angled surface extending from the front surface 13 on a bottom side of the ejector 12 in a direction toward the bottom rear of the ejector 12. The angled surface is a feature that prevents over insertion of the magazine 80.

Figure 15A:
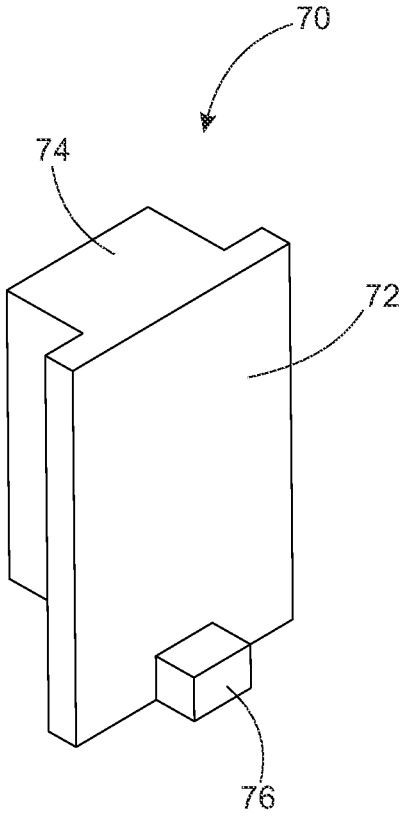
FIG. 15A is a perspective view of gap filling devices of a carbine assembly in accordance with embodiments.
Figure 15B:
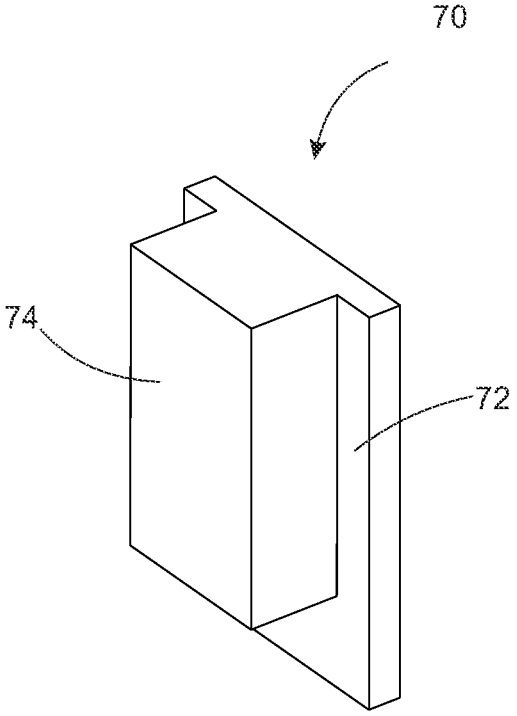
FIG. 15B is a perspective view of gap filling devices of a carbine assembly in accordance with embodiments.
Figure 16:
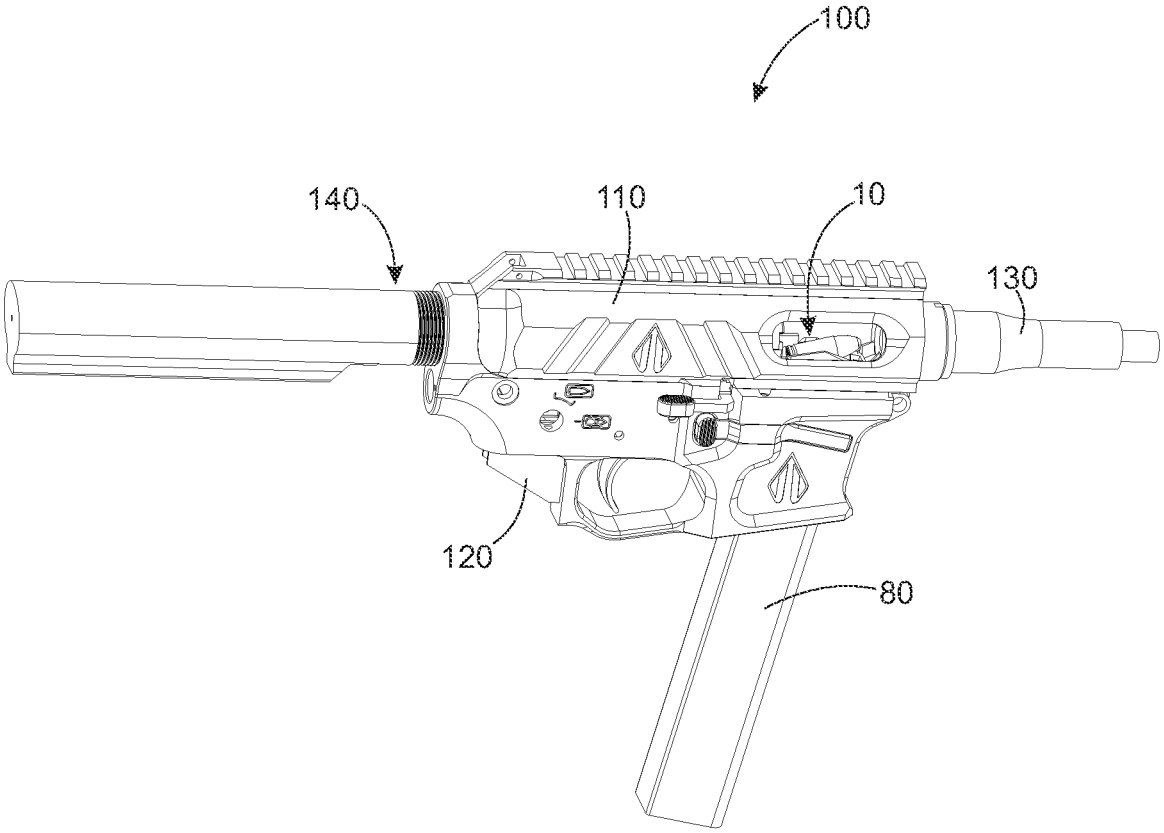
FIG. 16 is a perspective view of portions of a weapon with the carbine assembly coupled thereto in accordance with embodiments.

An embodiment of the gap filling device 70 is depicted in FIG. 15. The gap filling device 70 operates to couple to the lower receiver 120 and fill a gap 124 created in the lower receiver 120 by use of this invention (See FIGS. 3 and 6). The lower receiver 120 has a gap 124 on both sides so the same lower receiver 120 can be used by both right-hand and left-hand shooters, wherein the upper receiver 110 may be specific to a right-handed or lefthanded shooter with the same components shown in FIGS. 4A-5 just mirrored depending on the right-handed or left-handed shooter desirability. The gap filling device 70 fills the gap 124 not being used based on whether the shooter is a right-handed or left-handed shooter.

Figure 3:
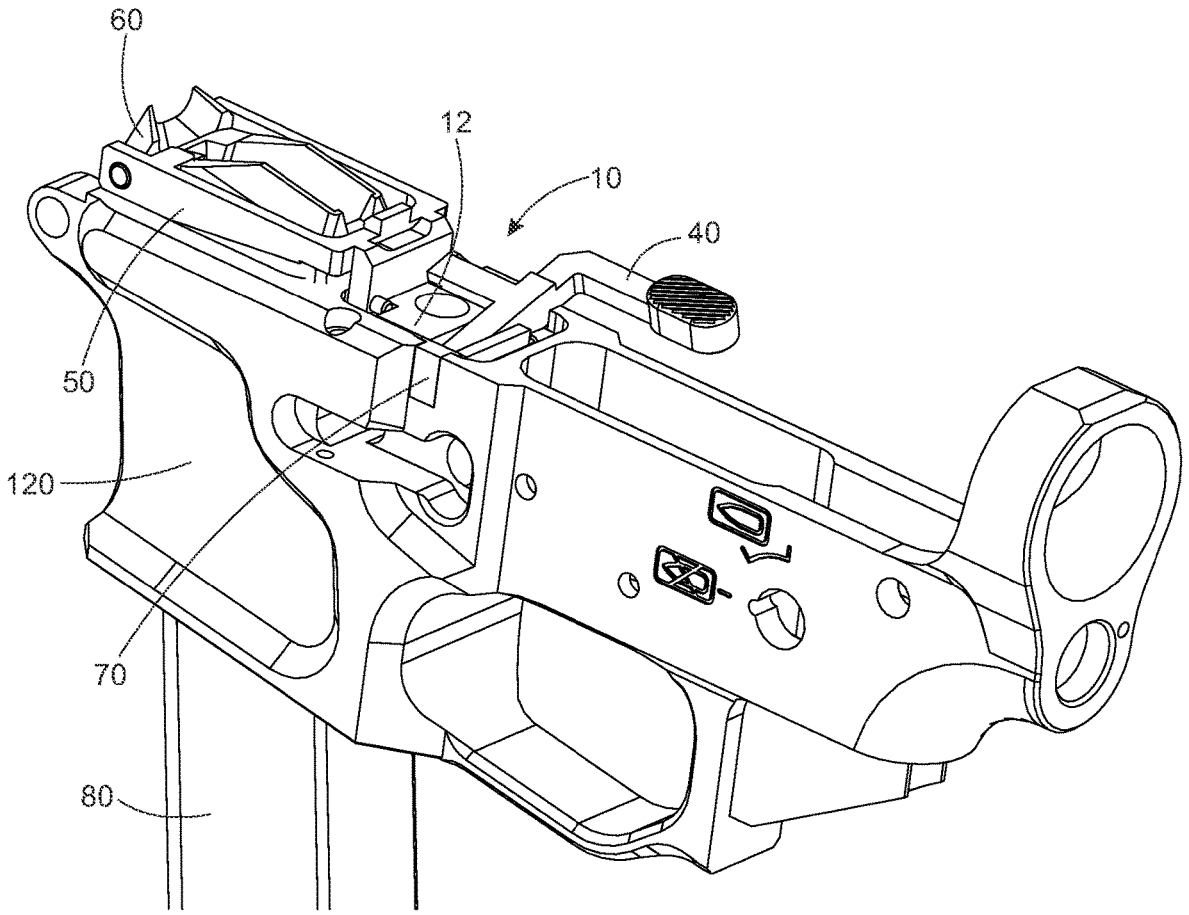
FIG. 3 is a perspective view of a portion of a carbine assembly in accordance with embodiments.

In operation, a shown in FIGS. 1-3, a magazine 80 may be coupled to the lower receiver and extend through the space 51 of the bolt stop 50. The bottom slanted surface of the ejector 12 keeps the magazine 80 from extending to far into the lower receiver to ensure that the ammunition 82 is in the proper location to be fired. The carbine assembly may operate to load and the ammunition 82 within the barrel 130 using the feed ramp 60 to ensure that ammunitions 82 is accurately loaded and then shoot the ammunition 82 and recoil to allow the cartridge to be expelled through an opening in the upper receiver 110 by use of the ejector 12. When the last round of ammunition 82 stored within the magazine 80 is shot and the bolt recoils, the magazine follower 84 extends out from the magazine 80 and engages the activation tab 54 of the bolt stop and rotates the bolt stop body 52 about the bolt stop pivot holes 53 such that the bolt stop tab 56 is lifted to interfere with the bolt carrier 140 from extending over the magazine and stop the bolt carrier 140 from operating. The rotation of the bolt stop body 52 lifts the control bosses 58 of the bolt stop 50 that is engaged with the boss interface slot 49 of the control lever 40 and rotates it about the pivot hole 46. The shooter operating the carbine assembly 100 may then remove the magazine 80 that is empty and put a new magazine within the carbine assembly 100. The shooter may then depress the finger pad 42, wherein depressing the finger pad 42 allow the boss interface slot 49 to move down and rotate the bolt stop body 52 about the pivot holes 53 by engaging with the control bosses 58. This rotates the bolt stop tab 56 out of the way from the bolt and the carbine assembly 100 may operate to shoot ammunition 82 again.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A carbine assembly comprising:

an upper receiver;

a lower receiver with a magazine fillable with ammunition, wherein the magazine is removably coupled to the lower receiver; and a bolt stop/feed assembly coupled within the upper receiver and the lower receiver, the bolt stop/feed assembly comprising a bolt stop rotatably coupled to a feed ramp, wherein the bolt stop rotates with respect to the feed ramp and the bolt stop/feed assembly is configured to feed ammunition into a barrel of the carbine assembly and stop operation of the bolt carrier when a last round of ammunition is fired from the carbine assembly upper receiver.

2. The assembly of claim 1, further comprising an ejector coupled to the upper receiver.

3. The assembly of claim 1, wherein the feed ramp comprises a cartridge feed ramp surface that extends from a first surface to a second surface of the feed ramp.

4. The assembly of claim 3, wherein the feed ramp further comprises protrusion members extending from each side of the feed ramp surface, each protrusion member having a tapered surface, wherein the feed ramp surface and protrusion members with tapered surfaces operate to direct a round of ammunition into the barrel.

5. A carbine assembly comprising:

a lower receiver with a magazine fillable with ammunition, the magazine removably coupled to the lower receiver, wherein the lower receiver comprises:

a right-side gap and a left-side gap for receiving a control arm through the right-side gap for a right-hand shooter or receiving the control arm through the left-side gap for a left-hand shooter; and a gap filling device removably coupled to the left-side gap for a right-hand shooter and coupled to the right-side gap for a left-hand shooter;

an upper receiver configured for a left-hand shooter or a right-hand shooter;

a bolt stop/feed assembly coupled within the upper receiver and the lower receiver and operatively coupled to the control arm, the bolt stop/feed assembly comprising a bolt stop rotatably coupled to a feed ramp, wherein the bolt stop rotates with respect to the feed ramp and the bolt stop/feed assembly is configured to feed ammunition into a barrel of the carbine assembly and stop operation of the bolt carrier when a last round of ammunition is fired from the carbine assembly upper receiver.

6. The assembly of claim 5, further comprising an ejector coupled to the upper receiver.

7. The assembly of claim 5, wherein the feed ramp comprises a cartridge feed ramp surface that extends from a first surface to a second surface of the feed ramp.

8. The assembly of claim 7, wherein the feed ramp further comprises protrusion members extending from each side of the feed ramp surface, each protrusion member having a tapered surface, wherein the feed ramp surface and protrusion members with tapered surfaces operate to direct a round of ammunition into the barrel.

* * * * *